United States Patent [19]

Grigas

[11] Patent Number: 4,726,589

[45] Date of Patent: Feb. 23, 1988

[54] GOLF COURSE

[76] Inventor: Peter D. Grigas, 337 San Leandro, Diamond Bar, Calif. 91765

[21] Appl. No.: 874,730

[22] Filed: Jun. 16, 1986

[51] Int. Cl.[4] ..... A63B 67/02

[52] U.S. Cl. ..... 273/176 R; 273/176 AB; 273/176 E; 273/176 K

[58] Field of Search ..... 273/176 R, 176 A, 176 AA, 273/176 AB, 176 E, 176 G, 176 K, 176 L, 35 B

[56] References Cited

U.S. PATENT DOCUMENTS

| | | | |
|---|---|---|---|
| 2,455,806 | 12/1948 | Reach | 273/32 |
| 2,490,961 | 12/1949 | Hendry | 273/176 A |
| 2,894,749 | 7/1959 | Rook | 273/176 |
| 3,129,943 | 4/1964 | McKee | 273/176 A |
| 3,156,470 | 11/1964 | Newkirk | 273/176 AB |
| 3,310,310 | 3/1967 | McKee | 273/176 A |
| 3,348,846 | 10/1967 | Atchison | 273/176 E |
| 3,567,223 | 3/1971 | Gentiluomo | 273/35 B |
| 3,580,583 | 5/1971 | Gentiluomo | 273/176 |
| 3,594,006 | 7/1971 | Clatt | 273/176 |
| 3,599,980 | 8/1971 | Harmond | 273/176 A |
| 3,602,506 | 8/1971 | Gentiluomo | 273/35 |
| 3,685,832 | 8/1972 | Johnson | 273/176 A |
| 3,706,452 | 12/1972 | Soucie | 273/35 R |
| 3,708,173 | 1/1973 | Hewson | 273/176 A |
| 3,719,360 | 3/1973 | Purdy | 273/176 A |
| 3,719,361 | 3/1973 | Rotolo | 273/176 AB |
| 3,797,827 | 3/1974 | Child | 273/35 R |
| 3,999,764 | 12/1976 | Nitsche | 273/176 A |
| 4,157,831 | 6/1979 | Renn | 273/176 AB |

OTHER PUBLICATIONS

*Golf World Publication,* Jul. 20, 1962, p. 15 "Speed--Links".

Gold Digest March, Mar. 1979, pp. 122–125, "Play 18 . . . ".

*Primary Examiner*—Gary L. Smith

*Assistant Examiner*—Eric K. Nicholson

*Attorney, Agent, or Firm*—Nilsson, Robbins, Dalgarn, Berliner, Carson & Wurst

[57] ABSTRACT

A compact golf course is divided into a plurality of sections by intersecting covered passageways which enable the golfer to transmit common fairways between greens and tees disposed around the perimeter of the course, with balls falling within the interior of the course being collected by the sections and transported to covered hitting areas accessible by the passageways.

8 Claims, 3 Drawing Figures

GOLF COURSE

FIELD OF THE INVENTION

This invention relates to golf games and more particularly to a compact golf course for providing play in a minimal area.

BACKGROUND OF THE INVENTION

Due to the increasing difficulty of obtaining large sections of land in densely populated areas, golf courses are generally found some distance from population centers, and the cost of maintaining a full scale golf course has increased substantially. The popularity of the game of golf has thus led to the development of a number of factitious golf games and driving ranges in which a player can indulge certain aspects of the sport within a limited area. While such games provide amusement, players are not able to exercise the wide range of skills enjoyed in playing the game on an orthodox golf course.

Attempts have been made in the past to meet this need. For example, U.S. Pat. No. 2,455,806 shows a compact golf course on which the balls are not retrieved after being hit by the players, and the score is calculated by arbitrary rules rather than repeatedly hitting a single ball from the tee to the green of each particular hole. U.S. Pat. No. 2,894,749 describes an enclosed, compact golf game where the players hit balls on fairways formed within tunnels which run from the tee to the green. U.S. Pat. No. 3,599,980 describes a golf course having three spaced-apart greens disposed on a single fairway, and a ball-return system for returning the balls from the course to the tees without the necessity of the player retrieving the balls. U.S. Pat. No. 3,708,173 describes a golf game including a number of putting greens arranged about a central building, which permits a large number of participants to play simultaneously, but the game in terms of golf shots is a chipping game rather than a driving or putting exercise. U.S. Pat. No. 4,157,831 describes groupings of tees and greens clustered together and disposed about the compact golf course, with the golfer moving across intercepting and overlapping fairways between the respective greens and tees so that an 18-hole course may be contained in a restricted area.

While the above described patents offer advances in the art, it is still a desideratum to provide a compact golf course which enables an individual to play 9 or 18 holes of golf on separate tees and greens using woods, irons and putters in a traditional manner, but which does not subject a player to the risk of transiting intersecting fairways, or require artificial scoring or unnatural play.

SUMMARY OF THE INVENTION

The present invention provides a compact golf course and golf game which allows play under nearly all weather conditions during the day or under artificial lighting, over 18 different fairways of from 200 to 450 yards in length, on a total playing area of less than 20 acres.

Briefly, the golf course game includes a playing field of predetermined configuration, such as a polygon or circle, which is divided into sections including a golf ball receiving and transporting means, and an array of covered conduits. The conduits are of a size which is sufficient to permit the passage of golfers and have a top which is covered with a material which is impervious to golf balls, and may be covered with a material which is also impervious to water. Accordingly, the golfer is never in a position during fairway transit where there is exposure to weather or to the risk of being struck by balls moving above the conduits. Tee and green areas are also included, preferably on the periphery of the playing field, and may include protective means disposed on the top, back and sides of the areas to further protect the player from errant balls during the teeing and putting procedures. Intermediate hitting areas are also included, preferably on the interior of the playing field, to permit the player to execute intermediate strokes in the traditional fashion. Each intermediate hitting area may serve to play balls on any hole, depending upon the section into which the ball falls. The hitting areas may be finished with rough foliage, water or sand traps, if desired, to provide normal hazards for golf play.

The surface of the sections formed by the array of conduits has a surface which slopes downwardly toward a ball receiving means, such that a golf ball deposited within the section rolls into the receiving means, and thereafter into a means for transporting the ball to an appropriate hitting area. A first group of sections includes hitting areas for hitting golf balls into other sections, the hitting areas preferably being elevated with respect to the sloping surface of the section. Balls which are hit from a teeing area or otherwise into one of the sections thus gravitate into the ball receiving means, and ball transport means move the ball so deposited to a selected hitting area associated with that section. Preferably, the compact golf course has greens and tees located along the edge of a polygon, such as a square or rectangle. Generally, a total area of 8 or 10 acres is sufficient for a 9-hole golf course, and a total acreage of about 20 acres permits 18 playing holes with many fairways in excess of 400 yards in length. The conduits traverse the golf course in the manner of enclosed passageways or tunnels at ground level so that players may cross the playing field without fear of being struck by golf balls and without being exposed to inclement weather.

The tees are placed at a level such that balls may be hit from the tees without risk of directly impacting the conduits. The tees are protected by a weather resistant roof, and balls are driven from the tees toward the respective greens. When the ball does not arrive at the green and falls elsewhere within the perimeter, it must fall within one of the sections and will be directed by the downward slope to an automatic ball mover and then transported to one of the subordinate hitting areas, also above the top of the passageways and sheltered, where the ball may again be directed by the golfer toward the appropriate green. The golfer will approach the subordinate hitting area through the tunnels to avoid being struck by intersecting golf balls. The subordinate hitting areas may have natural or artificial grass so that approach shots approximating those made on a natural fairway can be made. Accordingly, a golfer can use all golf clubs normally used in a full-sized golf course. Due to the conduits and covers which may be disposed over the tees and greens, the golfer is never in a position where there is exposure to weather or to the risk of being struck by balls traversing the golf course.

DETAILED DESCRIPTION

Details of illustrative embodiments of the invention are disclosed. However, it is to be understood that these embodiments merely exemplify the invention which may take forms different from the specific embodiments disclosed.

Figure 1:
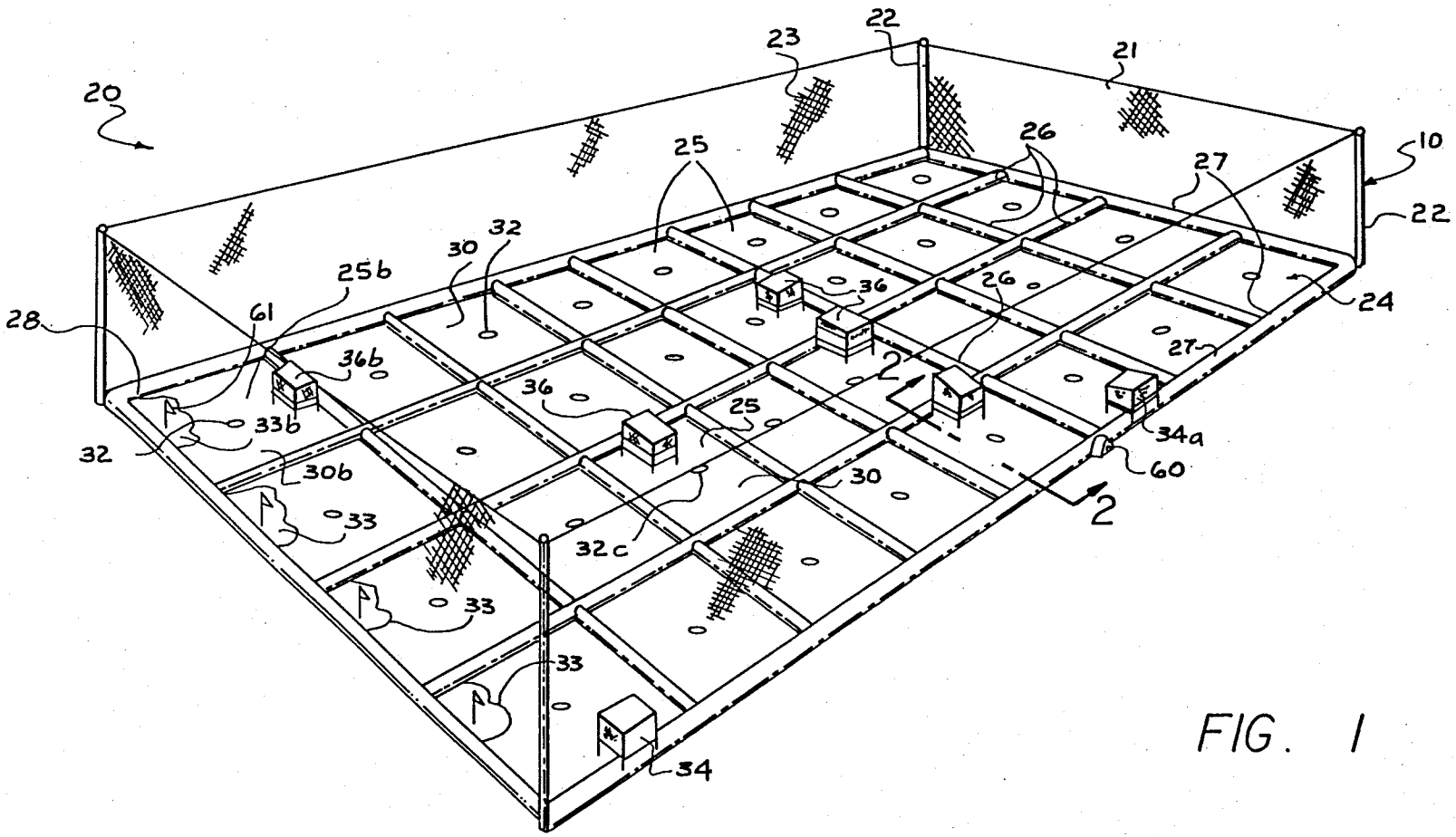
FIG. 1 is a perspective view showing a golf course of the present invention.

In FIG. 1, a golf course 20 is shown which measures 400 yards in length by 200 yards in width. The golf course 10 comprises an 18-hole, 72 par golf course which takes up a total area of less than 20 acres. The course 20 is seen to be surrounded by a high fence 21 which is constructed from supporting poles 22 and a woven wire, chain-link or hardware cloth material 23 therebetween to form a ball deflection means, impervious to golf balls, which is of a height sufficient to contain all golf balls hit on a playing field portion 24 within the fence 21.

The playing field 24 is seen to be divided into a plurality of sections 25 by an array of intersecting interior conduits, passageways or channels 26. A bordering passageway or conduit 27 which is similar or identical to the conduits 26 borders the playing field 24 and connects with each of the conduits 26 at the outermost edges thereof. While the passageways 26 and 27 may be constructed in most any manner from a wide variety of materials, it is preferred that a clear material such as plexiglass or Lexan (TM General Electric Co.) or other polycarbonate resins be employed to afford a pleasing view to golfers passing through the conduits. The conduits 26 and 27 are of a size which is sufficient to allow passage of at least two side-by-side golfers therethrough and preferably are about 8 feet tall and about 6 feet wide. If desired, the conduits may be wide enough to permit the passage of golf-carts, or include a conveyor-type treadway for the transport of golfers and equipment. Generally, the floor of the conduits 26–27 will be at surface level, above or below. If the floor of the conduits is above the surface of the surrounding sections, the sections may meet at an apex between adjoining sections so that a ball falling beneath the conduits is directed to one or another of the sections depending upon the angle of impact. The top of these conduits is smooth and downwardly sloping to prevent the snagging of balls which may strike the top of the conduit, and in this regard the top of the interior passageways 26 are preferably convex to allow balls dropping directly on the center of the conduit to fall randomly on either side thereof. With respect to the bordering conduits 27, the downwardly and inwardly sloping top 28 is seen to closely abut the woven wire 23 so that golf balls striking the fence will roll easily across the top 28 without lodging therebetween.

Each of the sections 25 of the playing field 24 include a surface 30 which slopes downwardly toward a hole 32 which comprises a ball receiving means. A ball falling within any one of the sections 25, or on one of the adjacent conduits, will be directed by gravity by the downwardly sloping surface 30 into the ball receiving means 32. The receiving means 32 and the apparatus associated therewith will be discussed in more detail with respect to FIG. 2.

The perimeter sections of the playing field 24 may each contain a putting green area shown in the leftmost sections of FIG. 1 and indicated by the reference numeral 33. The perimeter areas may also include tee areas, indicated by the reference numeral 34. Each of the sections 25 also include a hitting area, indicated by the reference numeral 36. Each of the hitting areas, as well as the tee areas 34 and putting greens 33, is connected to and accessible from one of the conduits 26–27. Additional detail with respect to the hitting areas 36, and the accessibility of the tee, hitting and green areas from the conduits will be explained with respect to FIG. 2.

Figure 2:
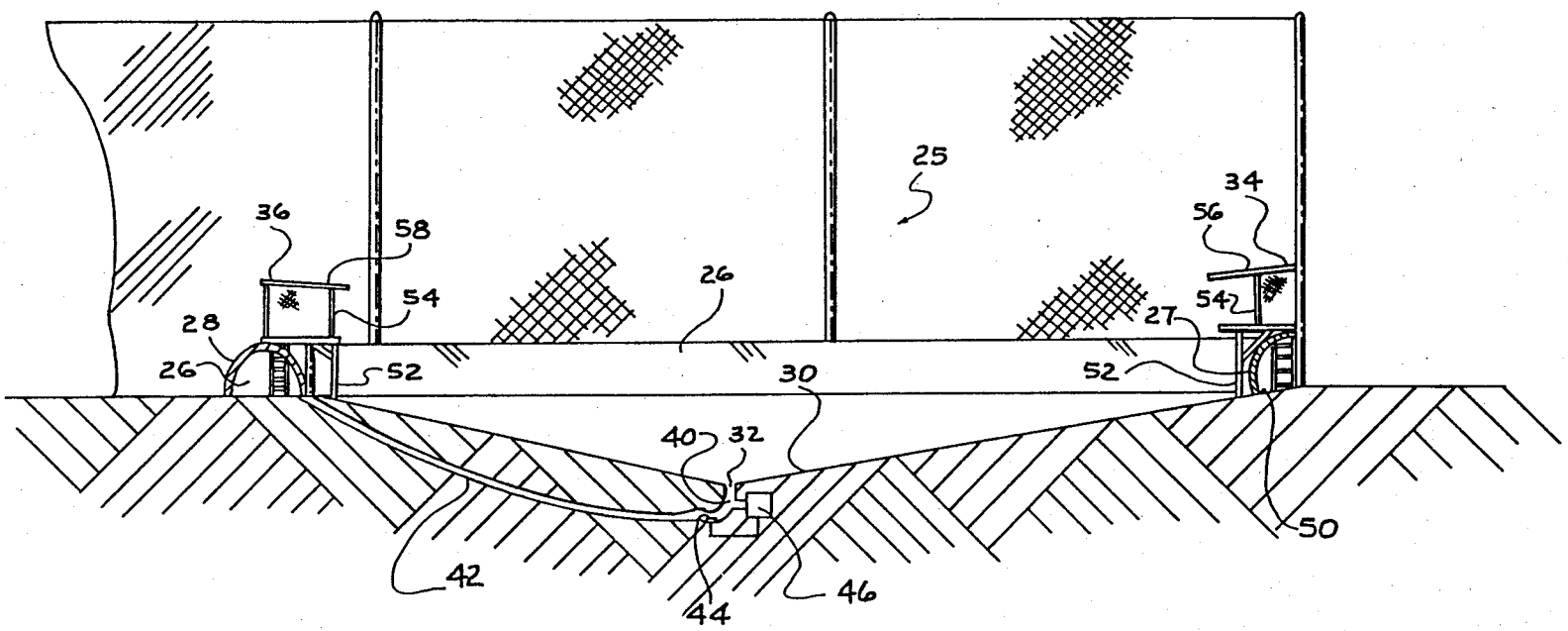
FIG. 2 is a side view, partially in cross-section taking along the lines 2—2 of FIG. 1.

In FIG. 2, a portion of one of the sections 25 is shown to be bounded, at the rear and sides of the view shown in the Figure by the passageways 26. As is shown in more detail in FIG. 2, the tops 28 of the passageays 26 are seen to be inclined downwardly and outwardly so that golf balls which land atop the conduits are deflected toward and roll onto the downwardly inclined surface 30 to a ball receiving means 32. The means 32 is seen here to take the form of a tubular member 40 which is of sufficient size to receive a single golf ball. The size of the member 40 and the slope of the surface 30 immediately surrounding the means 32 should be such that two or more golf balls which roll toward the means 32 at the same time do not interlock or wedge within the member 40. After passing through the member 40, the ball will enter a transport tube 42 which initially slopes downward to a sensing means 44, for example, a microswitch or other device which will detect the presence of a golf ball. The sensing means 44 in this instance actuates a blower 46 which serves to propel the golf ball upwardly through the ball transport means 42 to a position adjacent the hitting area 36. The ball may be dispensed within the passageway 26 beneath the area 36, or may be carried by the ball transport means 42 to a position within the hitting area 36.

In some instances, it may be preferable to have the ball dispensed from the top of one or more of the hitting areas 36 in random fashion, especially if the hitting area has portions including sand traps or other hazards. For example, the outlet of the ball transport means 42 could comprise a flexible tube or a splayed distribution means which randomly dispenses the ball into a fair, rough or hazard portion of the hitting area.

Any one of a number of ball transport means may be employed in connection with the present invention, and will not be described in more detail since such means are known in the art especially in connection with the construction and use of miniature golf courses. For example, a ball transport means and machinery for the retrieval of golf balls by a mechanical conveyor-like mechanism is explained in U.S. Pat. No. 3,706,452. Additional ball transport and ball return means are described in U.S. Pat. Nos. 3,580,583; 3,594,006; 3,599,980; 3,602,506; 3,708,173 and 3,797,827. The specification of each of these patents is incorporated herein by reference.

The conduits 26 and 27 are shown in FIG. 2 to be disposed at ground level, that is, with a floor 50 even at ground level. However, depending upon the particular surface or other factors regarding the environment surrounding the golf course 10, the conduits 26 and 27 may be disposed with a subterranean floor 50, although it is preferred that the conduits be no more than 4 feet below the surface 30 adjacent the sides of the conduits, so that golfers are afforded a clear view of the environment while traversing the passageways. The overall general construction of the conduits will be readily apparent to those skilled in the art, and a wide variety of construction methods and materials will be appropriate, although preferably a major portion of the conduits are constructed of a clear material to avoid a "tunnel" effect. An illustration of tunnel construction for use in an enclosed golf course is shown in U.S. Pat. No. 2,894,749 which is incorporated herein by reference.

As is the entire section 25, the tees 34 and the hitting areas 36 are constructed in a manner which avoids exposed horizontal or depressed surfaces which would entrap a golf ball. The tees and hitting areas are seen to be above the height of the tops of the conduits 26 and 27, and are supported by posts 52 which extend to the surface 30. Additional posts 54 support an inwardly and downwardly inclined roof indicated by the reference numeral 56 for the tee 34, and by the reference numeral 58 for the hitting area 36. Preferably, a wire screen is seen to serve, in connection with the roof 56, as a ball deflecting means to protect golfers within the respective tees or hitting areas from golf balls struck by other golfers. In addition, a similar wire screen is provided at the back and other side of the respective areas. Depending upon the amount of play and the positioning of the tee 34 or the hitting area 36, wire protective curtains may be provided across the front of the tee and hitting areas, which may be drawn by the golfers or by automated means when the way is clear for the golfer within the area to play a ball. For example, a plurality of sensors in the tee, green and hitting areas may provide data to a computerized control device which opens individual curtains when play is safe. The use of wire curtains or other ball deflecting means surrounding the area is particularly useful with respect to the internal hitting areas 36 from which it may be necessary to hit balls in any one of a number of directions. The ball deflecting means may also comprise trees which are placed around the areas 34 and 36. Preferably, the foliage of such trees is trimmed to a sufficient height to deflect balls falling from overhead, yet will not block shots made from the hitting areas. Such trees, if the trunks are appropriately faired into the sloping surface 30, will provide hazards which are natural in golf play or traditional courses and a pleasing visual effect.

It will be apparent from the foregoing description that a golf game may be played on the golf course 20 wherein golfers are under cover at all times while transiting the golf course from the tees to the greens, and a number of golfers share a common fairway space. As is shown in FIG. 1, golfers enter the golf course 20 through an entrance door 60, thus gaining access to the conduits 26 and 27. After passing through the door 60, a right turn brings the golfer to one of the elevated tee areas 34, which is designated by the reference number **34*a* as being tee area No. 1. The golfer ascends to the tee area 34*a* by covered stairs or by other means which are not specifically shown in the drawing. When the golfer then draws any of the protective wire curtains which may be disposed about the front and sides of the tee area, and undertakes to hit the ball in the direction of the first green area 33*b*, in this instance a distance of about 330 yards. Assuming that the aim of the golfer is true but the drive lacks sufficient energy to traverse the complete distance to the first tee, the ball may fall within an internal section indicated by the reference numeral 25*c*, whereupon it is routed by the downwardly sloping surface 30*c* to the ball receiving means 32*c*. Thereafter, it is transported by a ball transport means, not specifically shown, to the hitting house 36*c*. The golfer, after striking the ball at tee 1, descends to the passageway 27 and walks to the hitting house 36*c* through the conduits 26. Thereupon, any protective mesh around the hitting house in the direction of the first green 33*b* may be withdrawn by the golfer or by automated means, and the golfer may then select an appropriate iron or wood and hit the equivalent of a fairway shot toward the first green 33*b*. The ball then may fall upon that green, whereupon the golfer may indulge normal putting shots to sink the ball in the green hole, indicated by the flag pole 61 disposed therein. Should the ball instead fall short within the left corner section 25 onto the downwardly sloping surface 30*b*, the ball will be transported by the ball receiving means 32*b* to the hitting house 36*b*, from which the golfer may attempt to chip the ball with an appropriate iron towards the green 33*b*. In this regard, it may be preferable to finish the surface of the internal hitting areas, such as the hitting area 36*c* from which the ball is struck in a natural or artificial grass similar to that found in a natural fairway. Similarly, several of the hitting houses near the perimeter such as the hitting area 36*b* may have the hitting surface filled with sand to simulate sand traps or other hazards. Further, additional sand traps, not specifically shown, or foliage can be disposed around several of the greens 33 if desired. Following sinking of the ball at the green 33*b*, and recording the score, the golfer then enters the conduit 26 or 27** and travels to the next teeing area.

Figure 3:
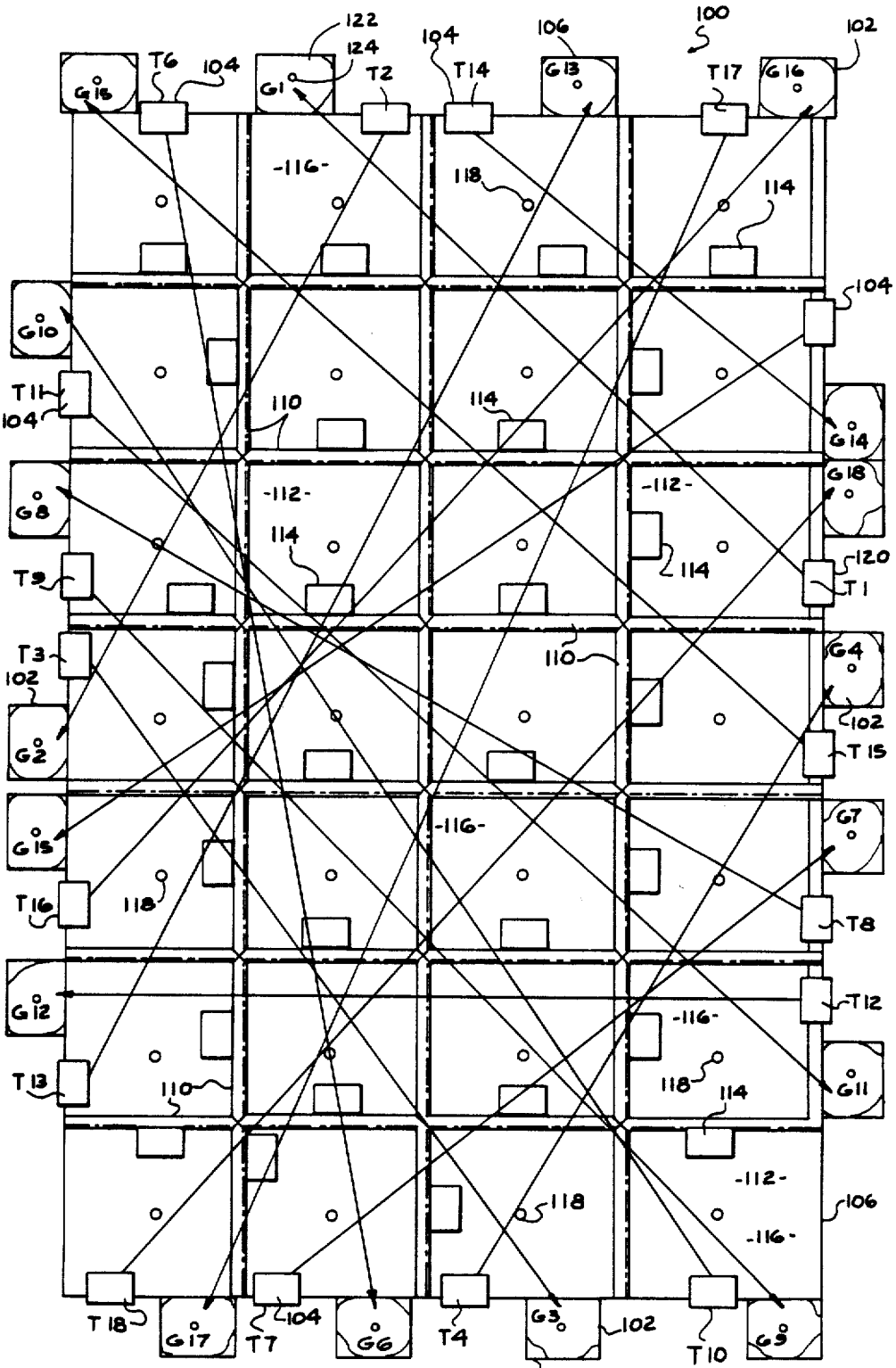
FIG. 3 is a schematic overview of the golf course game of the invention.

Turning now to FIG. 3, a variation of the golf course shown in FIG. 1 has a golf course 100 comprised of a plurality of perimeter green areas 102 and tee areas 104 such that lines joining the areas 112 and 114 form the outline of a polygon. The green areas are shown to each bear a number indicating a predetermined numbered golf course hole, in the key regions bearing a number for playing to a particular green region. In this embodiment, the green and tee areas are seen to be disposed beyond the edge of the general perimeter of the golf course 100 as opposed to being within the general perimeter of the golf course 20 in FIG. 1. Thus, a high woven wire fence 106 is seen to course around the green end tee areas 102 and 104 to encircle the golf course 100. As will be apparent from the drawing, the fence 106 will serve in many instances to protect the edges of the tee areas 104 from errant golf balls, and thus reduce the need for the wire screens 58 described with respect to FIGS. 1 and 2. The areas 102 and 104 are angled with respect to the adjacent areas to further improve golfer safety while teeing and putting.

The golf course 100 is also seen to include a plurality of interior conduits or passageways 110, which intersect and divide the golf course 100 into a plurality of sections 112. Since the fence 106 directly abuts the edges of the golf course 100 and the tee and green areas are directly accessible from without the golf course 100 through entranceways (not specifically shown), the need for bordering conduits such as those shown by the reference numeral 27 in FIG. 1 is eliminated. Accordingly, the conduits 110 are accessible in a similar manner through entranceways provided where the conduits abut the fence 106.

Each of these sections 112 includes a hitting area 114, and a surface 116 which slopes downwardly toward an aperture or ball receiving means 118. The construction of each of the sections 112 and the apparatus associated with the hitting areas, the surface 116 and the ball receiving means 118 have been described in detail with respect to FIGS. 1 and 2.

The schematic representation shown in FIG. 3 details the ability of a golfer to engage in playing 18 holes of golf upon a 20 acre golf course without being exposed to an open fairway. In particular, the golfer enters the first tee through a door 120. While in the first tee area, the woven wire screens thereabout protect against the majority of incoming golf balls, such as from the 18th tee, and the protective curtain in the direction of the first green may be withdrawn by the golfer or by automated means when the way is clear. The golfer then drives to the first green, and either is successful in obtaining the first green or the ball may fall within one of the hitting areas 112 therebetween. As described with respect to FIGS. 1 and 2, successive hits from the respective hitting areas finally enable the golfer to place the ball on the first green. When the ball successfully lands on the first green, the golfer exits the door 120 and walks, either outside of the fence 106 or through one of the channels 110, to reach the first green, whereupon entry to that green is attained through an external door not specifically shown. The first green, or any green in connection with FIG. 3 or the golf course in general, is seen to have a tailored green finished in a manner which is appropriate for a putting surface, and a hole 124 for sinking the golf ball. This green may also include sand or water traps between the fence 106 and the tailored green area 122, as well as shrubbery, trees, thick grass or other hazards normally found on natural golf courses. The green may also include a woven wire drape and partial roof, both of which are preferably impervious to the passage of golf balls, in order to protect the golfer while in that particular area.

Thereafter scoring on the first green, the golfer then exits and walks outside of the fence 106 to tee 2 and play is continued as shown.

The golf course of the present invention provides substantial advantages in allowing full course play, with fairways often extending far in excess of those employed on full-scale golf courses. Normal play including golf course hazards found on natural courses may be employed and a golfer's skill and traditional golf course strategy is important in playing the golf course of the invention, as slices, hooks or other errant balls seriously detract from a golfer's score which may be tallied in the manner of a normal golf game without the need for arbitrary scoring techniques.

While full course play of either 9 or 18 holes is preferred, a compact golf course having covered passageways and a plurality of individual ball collecting sections can be used for the practice and play of either iron or wood shots in combination with putting practice. For example, a course of approximately 100 by 200 yards could be employed to play 18 holes of a "pitch and putt" game wherein iron shots are employed to reach the green from the tee, that is, the use of the wood is omitted. Alternatively, a "drive and putt" game can be played on such a smaller course wherein the golfer attempts to drive the ball with a wood from the tee to the green. In this instance, the ball-receiving and transport means associated with the section adjacent to or containing the green would deliver the ball in a random fashion to a variety of locations on the green.

From the foregoing description, one skilled in the art can readily ascertain the essential characteristics of the invention and, without departing from the spirit and scope thereof can adapt the invention to various usages and conditions. For example, the compact golf course can be located on areas within population centers such as the tops of shopping malls or other similar areas. Changes in form and the substitution of equivalents are contemplated as circumstances may suggest or render expedient; and although specific terms have been employed herein, they are intended in a descriptive sense and not for purposes of limitation, the purview of the invention being delineated in the following claims.

What is claimed is:

1. A golf course which comprises:

a plurality of perimeter areas spaced from each other to form an enclosed configuration, the areas including green regions each bearing a number for indicating a predetermined numbered golf course hole and tee regions each bearing a number for playing to a particular green region;

at least one passageway having a top and sides which are impervious to golf balls and being of size sufficient to allow passage of a golfer therethrough, disposed across the configuration so that balls hit from each of the green regions may transit the golf course above and over said passageways and dividing an area within the configuration into a plurality of sections each bordered in part by one of the passageways, each of the sections having a surface downwardly-sloping toward a ball-receiving means;

a plurality of hitting areas disposed within the configuration, the hitting areas being accessible by a golfer from an adjacent passageway;

ball transport means disposed between the ball-receiving means and a hitting area, to transport a golf ball falling on the downwardly-sloping surface of the section.

2. A golf course which comprises:

a playing field having a perimeter and being divided into sections having downwardly-sloping surfaces, the surfaces of the sections sloping downwardly toward a ball-receiving means such that a golf ball deposited on the downwardly-sloping surface rolls into the ball-receiving means;

a first group of said sections including hitting areas for hitting golf balls into other sections, the hitting areas being elevated with respect to the sloping surface of the section, and a second group of said sections including putting green areas for putting the balls into holes;

an array of channels, the channels being of a size which is sufficient to permit the passage of golfers and having a top and sides which are impervious to golf balls, said channels being disposed so that balls may be hit from section to section across the top of at least one of the channels; and ball transport means to move a ball deposited in the ball-receiving means to a selected hitting area.

3. The golf course of claim 2 which further includes a third group of sections including tee areas for inititally striking the balls toward the putting greens.

4. The golf course of claim 3 wherein the sections including the tee and green areas are disposed around the perimeter of the field.

5. The golf course of claims 3 or 4 wherein the tee, green and hitting areas include protective means which are impervious to golf balls.

6. A golf course for playing with conventional golf clubs, comprising:

a playing field having a perimeter of predetermined configuration and divided into a plurality of sections into which a teed golf ball must fall, each such section having a downwardly-sloping surface adapted to direct a golf ball falling on said downwardly-sloping surface to a ball-receiving means;

a plurality of covered passageway means extending across the playing field and permitting access to each of said sections; at least one passageway crossing at least one other passageway;

a plurality of golf putting greens including putting cups disposed within a first group of sections which are spaced apart in relation to each other;

a plurality of tee areas spaced from each other within a second group of sections;

a hitting area disposed in a plurality of the sections; and ball transport means for transporting balls which are collected by the ball-receiving means of the sections to the hitting areas.

7. The golf course according to claim 6 wherein the passageways are constructed from a transparent material and have a top of sufficient height to permit the passasge of a golfer therethrough, and the hitting areas are sufficiently above the surface of the respective section such that the surface of the hitting area is at least level with the top of the passageways.

8. The golf course of claim 6 or 7 wherein the hitting areas are protected by golf ball deflection means.

* * * * *

UNITED STATES PATENT AND TRADEMARK OFFICE

CERTIFICATE OF CORRECTION

PATENT NO. : 4,726,589

DATED : February 23, 1988

INVENTOR(S) : Peter D. Grigas

It is certified that error appears in the above-identified patent and that said Letters Patent is hereby corrected as shown below:

Add: Fig. 3, sheet 3 of 3 to the patent

Signed and Sealed this

Thirty-first Day of January, 1989

*Attest:*

DONALD J. QUIGG

*Attesting Officer*

*Commissioner of Patents and Trademarks*

Peter D. Grigas